US008636377B2

(12) United States Patent
Cao et al.

(10) Patent No.: US 8,636,377 B2
(45) Date of Patent: Jan. 28, 2014

(54) LIGHT TUBE HOLDER FOR RECEIVING LED TUBE OR FLUORESCENT TUBE

(75) Inventors: Qing-Shan Cao, Shenzhen (CN); Jian-Pu Chen, Shenzhen (CN); Yu Hu, Shenzhen (CN)

(73) Assignees: Hong Fu Jin Precision Industry (ShenZhen) Co., Ltd, Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 174 days.

(21) Appl. No.: 13/301,797

(22) Filed: Nov. 22, 2011

(65) Prior Publication Data

US 2013/0003380 A1 Jan. 3, 2013

(30) Foreign Application Priority Data

Jun. 29, 2011 (CN) ..... 2011 1 0178346

(51) Int. Cl.
*F21V 21/00* (2006.01)

(52) U.S. Cl.
USPC ..... 362/217.13; 362/217.14; 362/217.17; 439/226

(58) Field of Classification Search
USPC ..... 362/217.1–217.17, 225; 439/226
See application file for complete search history.

(56) References Cited

U.S. PATENT DOCUMENTS

2011/0188238 A1 8/2011 Cao et al.

FOREIGN PATENT DOCUMENTS

| | | | |
|---|---|---|---|
| CN | 2309645 | Y | 3/1999 |
| CN | 1797869 | A | 7/2006 |
| CN | 201330950 | Y | 10/2009 |
| CN | 101839416 | A | 9/2010 |

*Primary Examiner* — Robert May
(74) *Attorney, Agent, or Firm* — Altis Law Group, Inc.

(57) ABSTRACT

A light tube holder includes a base and two connectors for receiving either a light-emitting diode (LED) tube or a fluorescent tube. The connector includes a rotary member rotatably received in a through hole defined in a retainer, and three conductive elastic pieces positioned in the retainer around the through hole. One elastic piece is electrically connected to an LED tube drive circuit board, and the other two elastic piece are electrically connected to a fluorescent tube drive circuit board. The rotary member can be rotated to first and second positions, wherein at the first position, the LED tube can be activated, and at the second position the fluorescent tube can be activated.

5 Claims, 7 Drawing Sheets

LIGHT TUBE HOLDER FOR RECEIVING LED TUBE OR FLUORESCENT TUBE

CROSS-REFERENCES TO RELATED APPLICATIONS

Related subject matter is disclosed in co-pending U.S. patent applications with a Ser. No. 13/301,799 and a title of ILLUMINATION DEVICE, a Ser. No. 13/301,800 and a title of ILLUMINATION DEVICE, a Ser. No. 13/301,801 and a title of ILLUMINATION DEVICE, a Ser. No. 13/301,805 and a title of ILLUMINATION DEVICE, a Ser. No. 13/301,808 and a title of ILLUMINATION DEVICE, and a Ser. No. 13/301,810 and a title of ILLUMINATION DEVICE, which have the same assignees as the current application and were concurrently filed.

BACKGROUND

1. Technical Field

The present disclosure relates to tube holders, and particularly, to a tube holder for adapting a light-emitting diode (LED) tube and a fluorescent tube.

2. Description of the Related Art

Generally, a conventional light tube holder for fluorescent tubes can not be used with LED tubes. When attempting to use an LED tube, the conventional light tube holder needs to be replaced. It is desirable and useful if a light tube holder can adapt to both fluorescent tubes and LED tubes.

Therefore, there is room for improvement within the art.

BRIEF DESCRIPTION OF THE DRAWINGS

The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
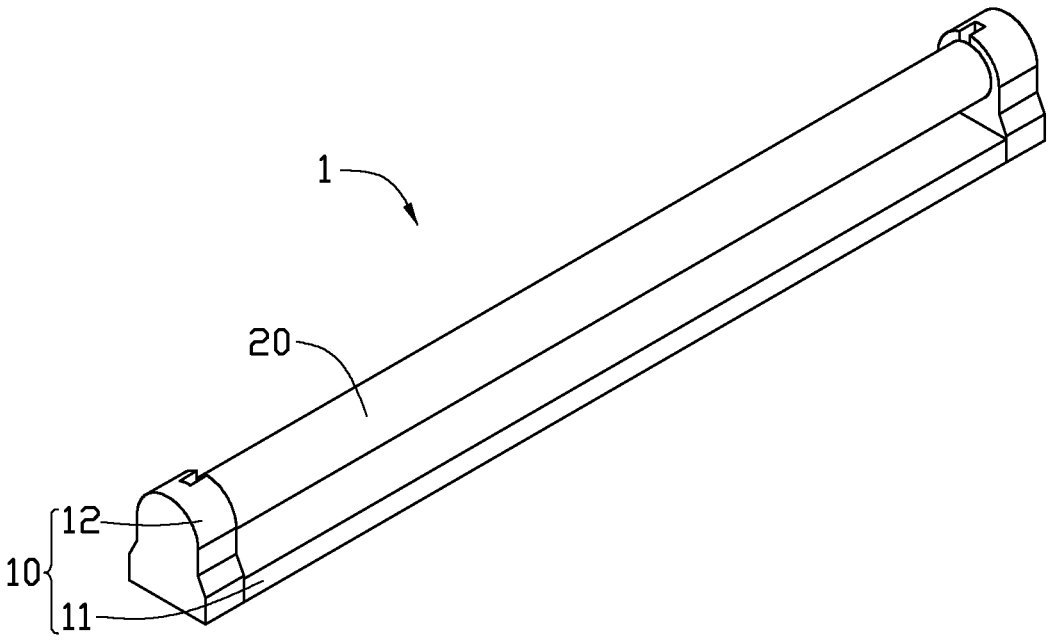
FIG. 1 is an isometric view of an illuminating device in accordance with an exemplary embodiment.
Figure 2:
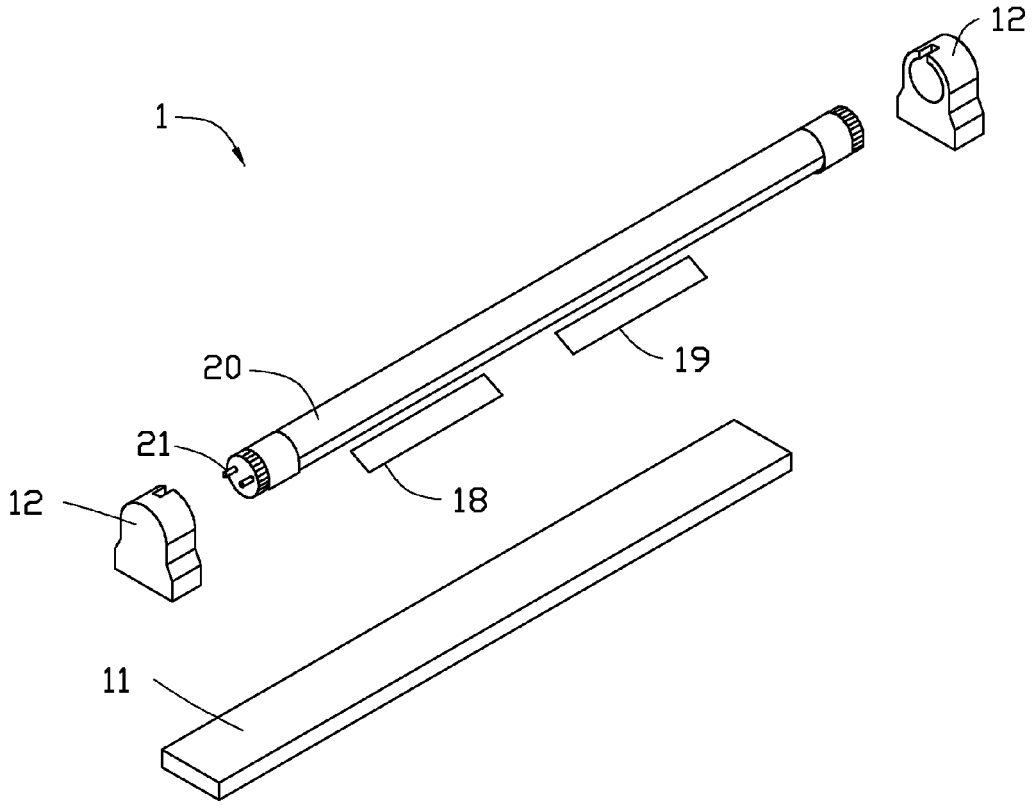
FIG. 2 is an exploded view of the illuminating device in FIG. 1.
Figure 3:
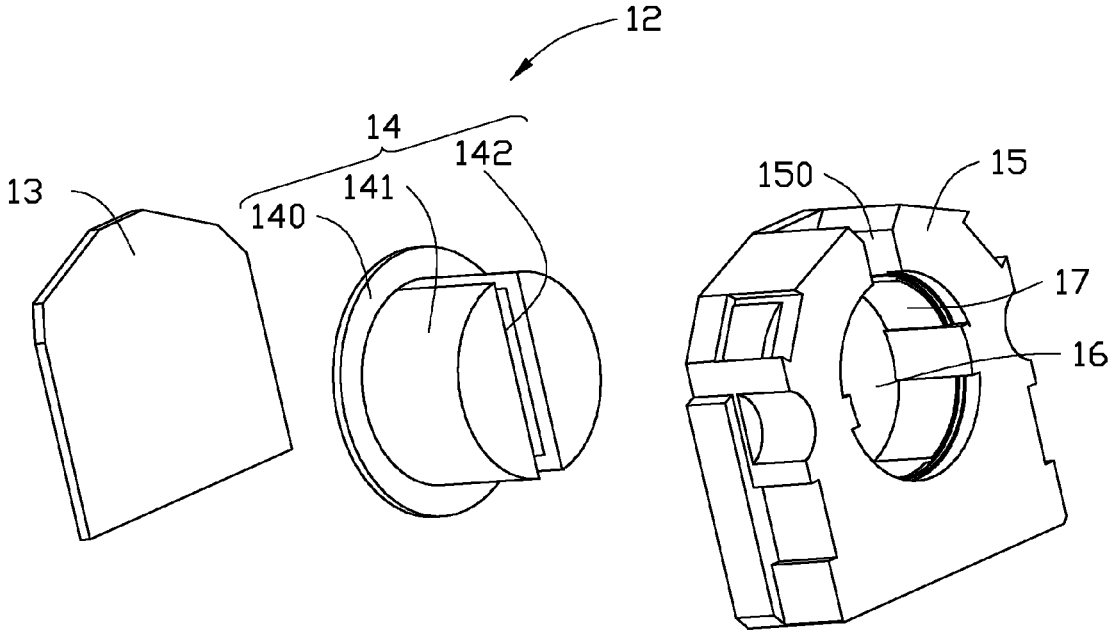
FIG. 3 is an exploded view of a connector of the illuminating device in FIG. 1.

Referring to FIGS. 1-3, an illuminating device 1 includes a tube holder 10 and a tube 20 mounted on the tube holder 10. The tube 20 can be a traditional fluorescent tube or a light-emitting diode (LED) tube. The LED tube has two pins on one end thereof and two pins on an opposite end thereof. The fluorescent tube has two conductive pins on one end thereof and two conductive pins on an opposite end thereof. The tube holder 10 can adapt a tube 20 in the both types. The tube holder 10 includes a base 11 and two connectors 12 at opposite ends of the base 11. Each connector 12 includes a cap 13, a retainer 15, and a rotary member 14. The cap 13 is attached to one end of the retainer 15. The cap 13 and the retainer 15 cooperatively define a space to receive the rotary member 14 therein. In the embodiment, a through hole 16 is defined in the retainer 15. The rotary member 14 is smaller in diameter than the though hole 16, thereby allowing the rotary member 14 to be received and to rotate in the through hole 16. The rotary member 14 is in the shape of a hat, including a brim 140, a body 141, and a first groove 142. The brim 140 is larger in diameter than the though hole 16, and abuts the outside end face of the retainer 15 around though hole 16. The first groove 142 is diametrically defined in the body 141 and divides the body 141 into two substantially equal parts. The first groove 142 can receive the two pins 21 of the tube 20 therein. An opening 150 is defined in the retainer 15, on a line substantially perpendicular to, and furthest from, the base 11, and extends from an external lateral surface to the sidewall of the through hole 16, and communicates with the through hole 16.

Figure 4:
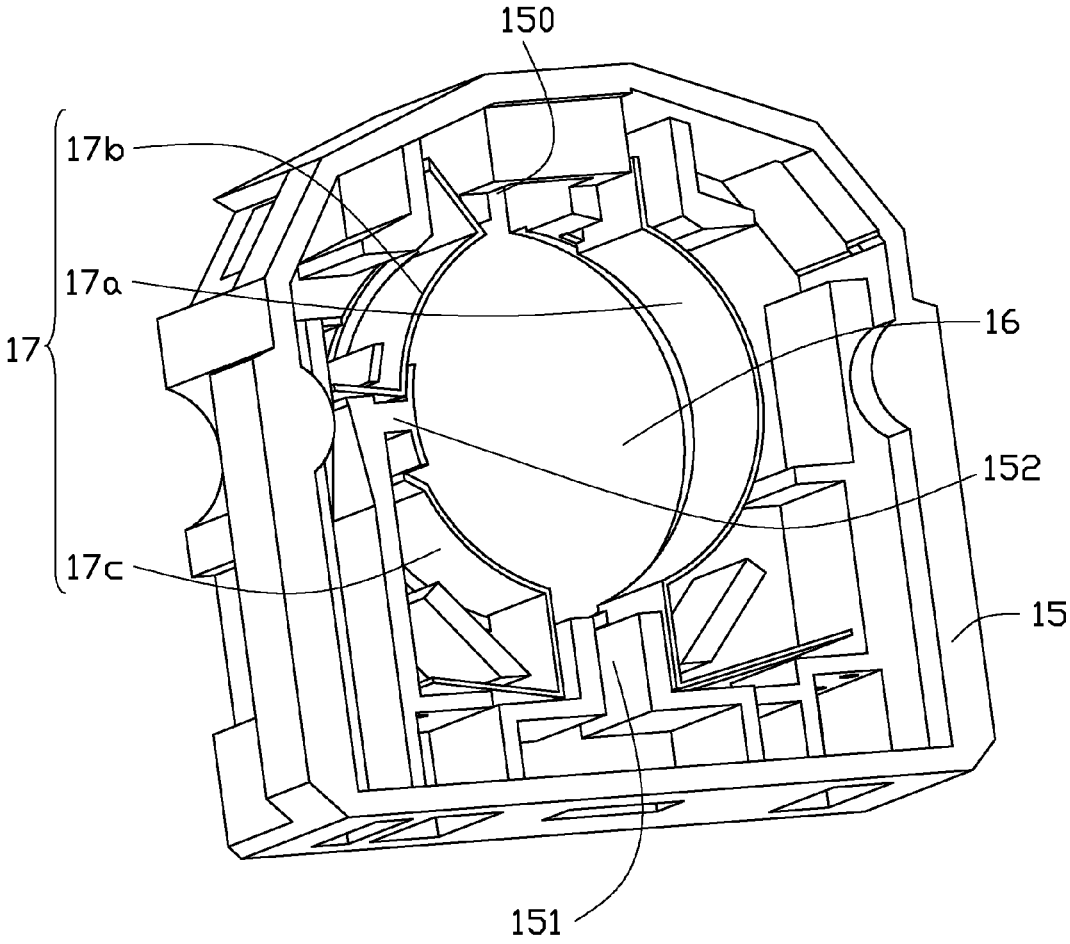
FIG. 4 is an isometric view of a retainer of the connector of the illuminating device in FIG. 3 according to a first exemplary embodiment.

Referring to FIG. 4, an elastic member 17 consisting of three elastic pieces 17*a*, 17*b*, 17*c* is positioned in the retainer 15 around the through hole 16. Each elastic piece 17*a*, 17*b*, 17*c* is made of an elastic metal sheet by stamping. The elastic piece 17*a* has a configuration of a half of a circle, while each of the elastic pieces 17*b*, 17*c* has a configuration of one fourth of a circle. A second groove 151 is defined in the retainer 15 opposite the opening 150. In this embodiment, at least one buffer pad 152 is defined on the side wall between the opening 150 and the second groove 151. The opening 150, the second groove 151, and the at least one buffer pad 152 are used to separate the three elastic pieces 17*a*, 17*b*, 17*c* of the elastic member 17 from each other. The three elastic pieces 17*a*, 17*b*, 17*c* of the elastic member 17 can then be electrically insulated from each other. The tube holder 10 further includes an LED tube drive circuit board 18 and a fluorescent tube drive circuit board 19 mounted in the base 11. The elastic pieces 17*a*, 17*b* are connected to the LED tube drive circuit board 18 and the elastic pieces 17*a*, 17*c* are connected to the fluorescent tube drive circuit board 19.

When installing the tube 20, the rotary member 14 is firstly rotated to cause the first groove 142 to align with the opening 150. The pins 21 of the tube 20 can then be inserted into the through hole 16 and supported in the first groove 142. The tube 20 can then be rotated to misalign the first groove 142 of the rotary member 14 with the opening 150, and securely retain the tube 20 in the retainer 15.

When the tube 20 is rotated to a predetermined position (indicated by a mark (not shown) on the connector 12), the rotary member 14 is rotated to a first position where the pins 21 of the tube 20 make contact with the elastic pieces 17*a*, 17*b* of the elastic member 17. Thus, the tube 20 can be driven by the LED tube drive circuit board 18. At the first position, the tube 20 is an LED tube 20 and can be driven by the LED tube drive circuit board 18 to generate light. When the element 14 is rotated to a second position, the pins 21 of the tube 20 make contact with the elastic pieces 17*a*, 17*c* of the elastic member 17, allowing the tube 20 to be driven by the fluorescent tube drive circuit board 19. At the second position, the tube 20 is a fluorescent tube 20 and can be driven by the fluorescent tube drive circuit board 19 to generate light. By virtue of these arrangements, the tube holder 10 can well adapt to any type of the tube 20.

In the first embodiment, the elastic member 17 includes three elastic pieces 17*a*, 17*b*, and 17*c*. The length of the elastic piece 17*a* is about 0.5A, where A represents the perimeter of the through hole 16. The lengths of the elastic pieces 17*b* and

17*c* are both 0.25A. The number of the at least one buffer pad 152 is one. Thus, the elastic pieces 17*a*, 17*b*, and 17*c* are separated from each other by the opening 150, the second groove 151 and the buffer pad 152.

In an alternative embodiment, the elastic pieces 17*a* and 17*b* may be connected to the fluorescent tube drive circuit board 19, and the elastic pieces 17*a* and 17*c* may be connected to the LED tube drive circuit board 18.

Figure 5:
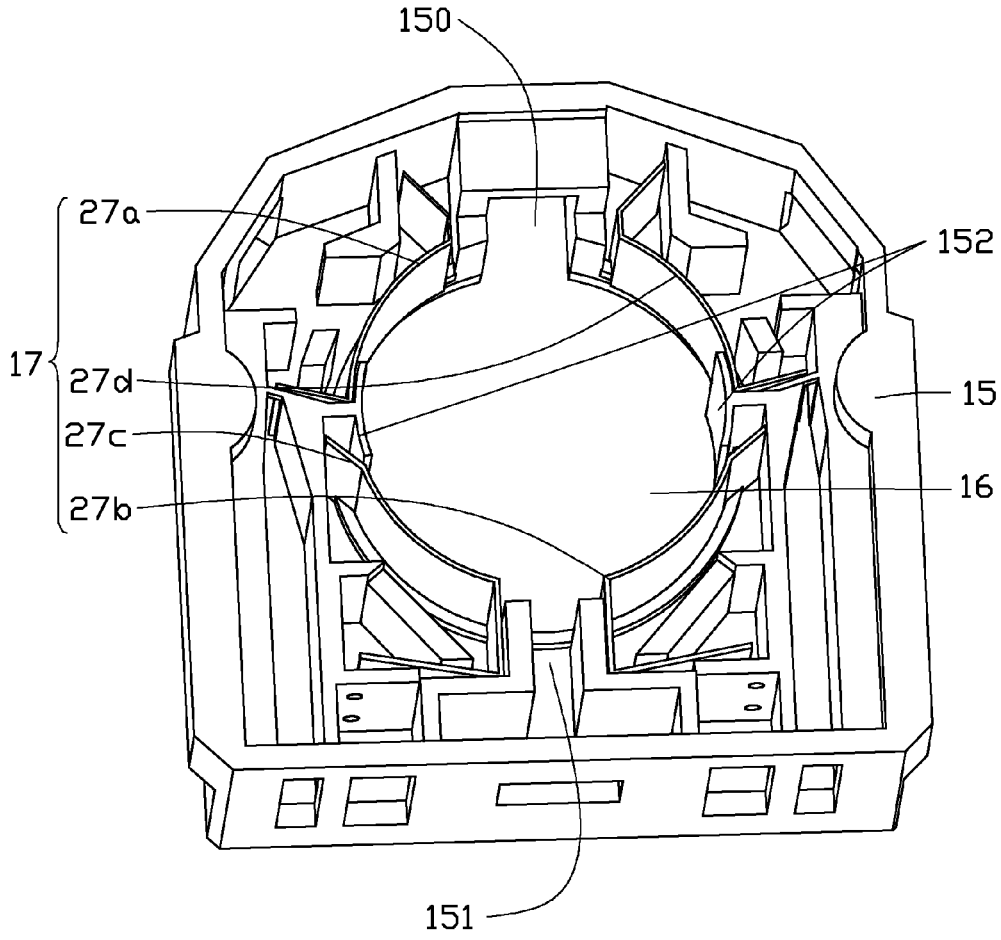
FIG. 5 is an isometric view of the retainer of the connector of the illuminating device in FIG. 3 according to a second exemplary embodiment.

Referring to FIG. 5, in a second embodiment, there are four elastic pieces 27*a*, 27*b*, 27*c*, and 27*d* constituting the elastic member 17. The lengths of the four elastic pieces 27*a*, 27*b*, 27*c*, and 27*d* are all 0.25A. The number of the at least one buffer pad 152 is two. Thus, the elastic pieces 27*a*, 27*b*, 27*c*, and 27*d* are separated from each other by the opening 150, the second groove 151 and the two buffer pads 152.

In the embodiment, the elastic pieces 27*a* and 27*b* are connected to the LED tube drive circuit board 18, and the elastic pieces 27*c* and 27*d* are connected to the fluorescent tube drive circuit board 19. The first position mentioned above is the position where the pins 21 of the tube 20 stay in contact with the elastic pieces 27*a* and 27*b*, and the second position mentioned above is the position where the pins 21 of the tube 20 stay in contact with the elastic pieces 27*c* and 27*d*.

Figure 6:
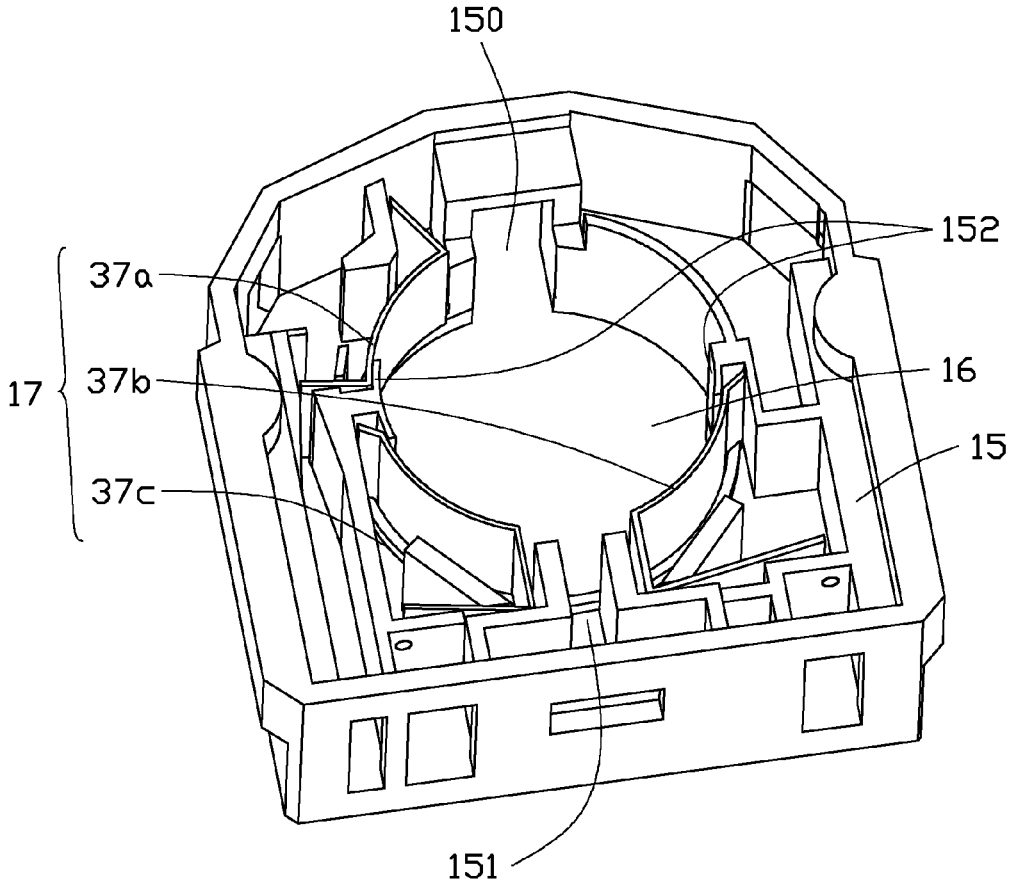
FIG. 6 is an isometric view of the retainer of the connector of the illuminating device in FIG. 3 according to a third exemplary embodiment.

Referring to FIG. 6, in a third embodiment, there are three elastic pieces 37*a*, 37*b* and 37*c* constituting the elastic member 17. The lengths of the three elastic pieces 37*a*, 37*b* and 37*c* are all 0.25A. The number of the at least one buffer pad 152 is two. Thus, the elastic pieces 37*a*, 37*b*, and 37*c* are separated from each other by the opening 150, the second groove 151 and the two buffer pads 152.

In the embodiment, the elastic pieces 37*a* and 37*b* are connected to the fluorescent tube drive circuit board 19, and the elastic pieces 37*c* are connected to the LED tube drive circuit board 18. The first position mentioned above is the position where two of the pins 21 of the LED tube 20 which are conductive and located respectively at opposite ends of LED tube 20 stay in contact with the elastic pieces 37*c* while the other two of the pins 21 which are insulating and located respectively at the opposite ends of the LED tube 20 do not contact anything, and the second position mentioned above is the position where the pins 21 of the fluorescent tube 20 stay in contact with the elastic pieces 37*a* and 37*b*.

Figure 7:
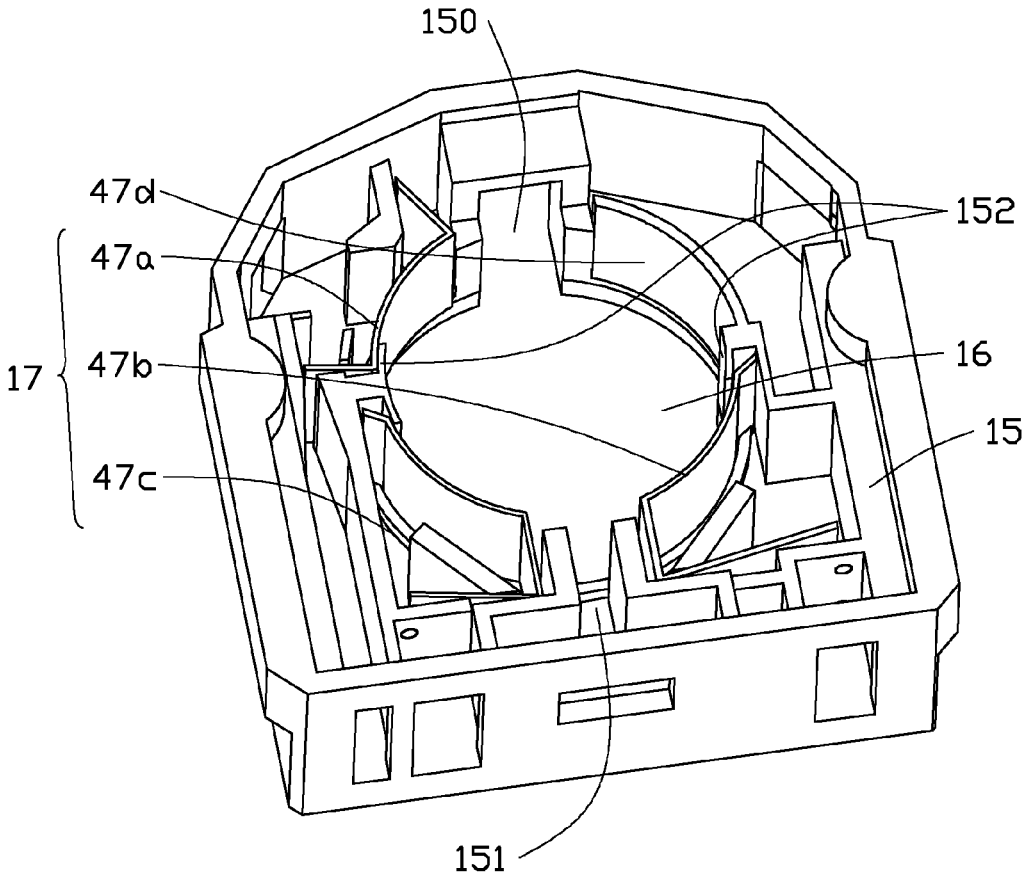
FIG. 7 is an isometric view of the retainer of the connector of the illuminating device in FIG. 3 according to a fourth exemplary embodiment.

Referring to FIG. 7, in a fourth embodiment, there are three elastic pieces 47*a*, 47*b*, and 47*c* constituting the elastic member 17. The lengths of the three elastic pieces 47*a*, 47*d*, and 47*c* are all 0.25A. An insulation piece 47*d* is positioned in the retainer 15 around the through hole 16 with the elastic pieces 47*a*, 47*b*, and 47*c*. The insulation piece 47*d* is resilient, and has a configuration of one fourth of a circle. The length of the insulation piece 47*d* is about 0.25A. The number of the at least one buffer pad 152 is two. Thus, the elastic pieces 47*a*, 47*b*, 47*c*, and the insulation piece 47*d* are separated from each other by the opening 150, the second groove 151 and the two buffer pads 152. The elastic pieces 47*a*, 47*b* of the two connectors 12 are connected to the fluorescent tube drive circuit board 19 and the elastic pieces 47*c* are connected to the LED drive circuit board 18.

When installing the tube 20, the rotary member 14 is rotated to a position where the pins 21 of the tube 20 stay in contact with the elastic piece 47*c* and the insulation piece 47*d*, the elastic piece 47*c* and the insulation piece 47*d* can tightly press against the two pins 21 of the tube 20, thereby holding the tube 20 in position.

In the embodiment, the elastic pieces 47*a* and 47*b* are connected to the fluorescent tube drive circuit board 19, and the elastic piece 47*c* is connected to the LED tube drive circuit board 18. The first position mentioned above is the position where two of the pins 21 of the LED tube 20 which are conductive and located respectively on two opposite ends thereof stay in contact with the elastic pieces 47*c* while the other two of the pins 21 which are insulating and located respectively at the opposite ends of the LED tube 20 stay in contact with the insulation pieces 47*d*, and the second position mentioned above is the position where the pins 21 of the fluorescent tube 20 stay in contact with the elastic pieces 47*a* and 47*b*.

The LED tube used in the embodiments of FIGS. 4 and 5 is an LED tube with two insulating pins on one end thereof and two conductive pins on an opposite end thereof. LEDs in the LED tube are serially connected between the two conductive pins at one end of the LED tube. The LED tube used in the embodiments of FIGS. 6 and 7 is an LED tube with an insulating pin and a conductive pin on each of two opposite ends of the LED tube. LEDs received in the tube are serially connected between the two conductive pins at the two opposite ends of the LED tube.

It is understood that the present disclosure may be embodied in other forms without departing from the spirit thereof. Thus, the present examples and embodiments are to be considered in all respects as illustrative and not restrictive, and the disclosure is not to be limited to the details given herein.

What is claimed is:

1. A light tube holder comprising:

a base;

a light-emitting diode (LED) tube drive circuit board mounted in the base;

a fluorescent tube drive circuit board mounted in the base;

a pair of connectors arranged at opposite ends of the base for selectively receiving one of a fluorescent tube comprising two pins at each end thereof, and an LED tube comprising two conductive pins at an end thereof and two insulating pins at an opposite end thereof;

wherein each of the pair of connectors comprises:

a retainer defining a though hole;

a rotary member rotatably received in the through hole, and defining a first groove to receive the two pins on one end of one of the tubes; and three elastic pieces positioned in the retainer around the through hole, the three elastic pieces comprising a first elastic piece, a second elastic piece, and a third elastic piece electrically insulated from each other, wherein the first elastic piece is opposite to the second elastic piece and the third elastic piece, the first and second elastic pieces are respectively connected to the LED tube drive circuit board, and the first and third elastic pieces are respectively connected to the fluorescent tube drive circuit board;

wherein when the rotary members of the pair of the connectors are rotated to a first position, the two pins on the one end of one of the tubes stay in contact with the first and second elastic pieces connected to the LED tube drive circuit board, and allow the tube to be driven by the LED tube drive circuit board when the tube is the LED tube; and when the rotary members of the pair of the connectors are rotated to a second position, the two pins on the one end of one of the tubes stay in contact with the first and third elastic pieces connected to the fluorescent tube drive circuit board, and allow the tube to be driven by the fluorescent tube drive circuit board when the tube is the fluorescent tube.

2. The tube holder as recited in claim 1, wherein the each of the three elastic pieces has an arced configuration.

3. The tube holder as recited in claim 2, wherein each of the connectors comprise an opening defined in the retainer and extending from an external lateral surface to a sidewall thereof surrounding the through hole, and communicating with the through hole.

4. The tube holder as recited in claim 3, wherein each connector further comprises:

a second groove defined in the retainer opposite the opening; and a buffer pad formed on the side wall, between the opening and the second groove, wherein the opening, the second groove, and the buffer pad separate the three elastic pieces from each other.

5. The tube holder device as recited in claim 3, wherein a length of the first elastic piece is about half of a perimeter of the through hole, and lengths of the second and third elastic pieces are both about a quarter of the perimeter of the through hole.

* * * * *